US006138642A

United States Patent [19]

Zhang et al.

[11] Patent Number: 6,138,642

[45] Date of Patent: Oct. 31, 2000

[54] METHOD AND SYSTEM FOR COMPENSATING FUEL RAIL TEMPERATURE

[75] Inventors: Xiaoying Zhang, Dearborn Heights; Timothy William Foster, Northville; Patrick J. Curran, Farmington Hills, all of Mich.; Ian Edington, Coventry, United Kingdom

[73] Assignees: Ford Global Technologies, Inc., Dearborn, Mich.; Jaguar Cars Limited, Coventry, United Kingdom

[21] Appl. No.: 09/151,240

[22] Filed: Sep. 14, 1998

[51] Int. Cl.[7] ..... F02M 51/00

[52] U.S. Cl. ..... 123/478; 123/480

[58] Field of Search ..... 123/478, 480, 123/497

[56] References Cited

U.S. PATENT DOCUMENTS 5,448,977 9/1995 Smith et al. ..... 123/478
5,505,180 4/1996 Otterman et al. ..... 123/497
5,848,583 12/1998 Smith et al. ..... 123/497
5,865,158 2/1999 Cleveland et al. ..... 123/478
5,902,346 5/1999 Cullen et al. ..... 701/102

*Primary Examiner*—Henry C. Yuen
*Assistant Examiner*—Arnold Castro
*Attorney, Agent, or Firm*—Allan J. Lippa; Roger L. May

[57] ABSTRACT

A method and system for fuel rail compensation in a returnless electronic fuel pump arrangement provides modification of fuel pulsewidth based on measured or inferred rail temperature. The present invention applies fuel pulsewidth control modifiers to enlarge the fuel pulse to increase the quantity of fuel being delivered to at least one fuel injector to offset any drop in fuel density and injector performance caused by fuel rail temperature. The present invention generates these modifiers separate from a vehicle's normal fuel delivery system adaptive control process, thereby eliminating any unnecessary adaptive processing and limiting of adaptive control range.

12 Claims, 1 Drawing Sheet

METHOD AND SYSTEM FOR COMPENSATING FUEL RAIL TEMPERATURE

TECHNICAL FIELD

The present invention relates to a system and method for controlling the operation of a fuel delivery system equipped with an electrically powered returnless fuel pump to improve fueling accuracy in an internal combustion engine.

BACKGROUND ART

Conventional electronic fuel injection systems use an electrically powered pump to supply fuel to the fuel injectors. The pump is controlled to operate at a constant speed. For newer pumping systems which do not return fuel to the fuel tank, i.e., an electronic returnless fuel pump, the absence of a return line from the fuel rail to the fuel tank may result in slightly higher fuel rail temperatures.

This may have the effect of changing physical characteristics of both the fuel and the fuel injector, such as causing the density of the fuel to decrease, and the electromechanical response of the fuel injector to be slower.

In certain types of fuel delivery systems, an adaptive algorithm is utilized to monitor and compensate for overall fueling error to the combustion engine. These errors are typically introduced by unit-to-unit variability in system components, as well degradation of such components as a result of aging or contamination. Adaptive systems usually employ an oxygen sensor, such as a heated exhaust gas oxygen (HEGO) sensor, to provide a feedback signal to the control algorithm, where the difference between a commanded air-to-fuel (A/F)ratio and an actual A/F ratio is then determined to generate the needed modification factor. These modification results are stored in a large keep-alive-memory (KAM) type memory arrangement, which is constantly updated in accordance with the detected error in A/F ratio.

While the adaptive process will ultimately deliver the desired fuel mass regardless of fuel temperature of injector response, such constant corrective action undesirably occupies a portion of range reserved by the adaptive process for unforeseeable in-use errors, thereby making the system less capable of providing other corrections.

Therefore, a need exists for a fuel delivery control arrangement which can compensate for rail temperature without taxing a vehicle's adaptive fuel delivery control process.

DISCLOSURE OF THE INVENTION

Accordingly, it is an object of the present invention to provide a method and system for fuel rail temperature compensation which is based on measured or inferred rail temperature, and is carried out separately from any other adaptive feed-forward control used in a vehicle fuel delivery system.

In accordance with a first aspect of the present invention, a method and system are provided for fuel rail temperature compensation to improve control of fuel delivered by at least one fuel injector in an internal combustion engine. The method includes detecting fuel rail temperature, generating both a slope compensation factor to compensate for changes in fuel density and an offset compensation factor to compensate for changes in fuel injector physical characteristics based on the detected rail temperature, and modifying the amount of fuel delivered by the least one fuel injector based on the generated compensation factors.

In accordance with one aspect of the invention, generating the compensation factors includes using the detected temperature as an input value to access a lookup table of predetermined slope modifier values and predetermined offset modifier values. If the rail temperature input falls between adjacent stored values, the adjacent values are averaged to generate the appropriate compensation factor. Fuel rail temperature can be detected either as a direct sensor measurement, or inferred as a function of other engine operating conditions.

The system of the present invention comprises at least one fuel injector for supplying fuel to an internal combustion engine, and a fuel rail temperature detector arrangement for detecting temperature of the fuel rail. A microprocessor-based controller is responsive to the fuel rail temperature detector arrangement and is arranged via suitable programming to generate a slope compensation factor to compensate for changes in fuel density and an offset compensation factor to compensate for changes in fuel injector physical characteristics based on the detected rail temperature. This is preferably accomplished by using the detected temperature as an input value to access appropriate lookup tables of predetermined slope and offset compensation values stored in a memory, and modify a control signal to the at least one fuel injector based on the generated compensation factors.

The above object and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
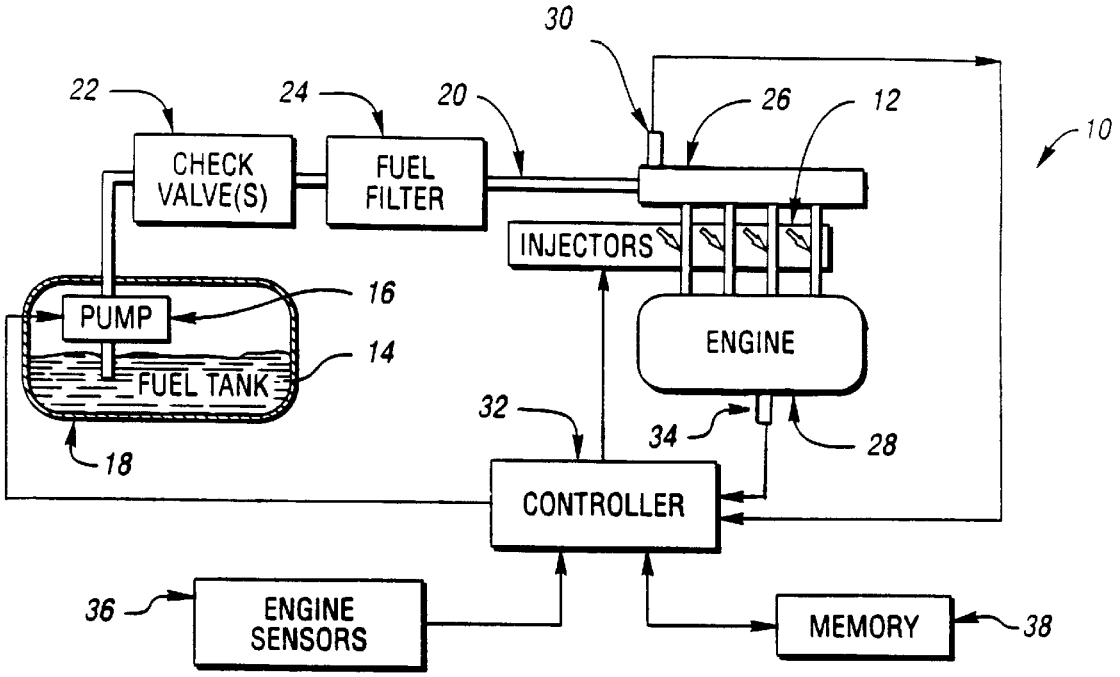
FIG. 1 illustrates an exemplary fuel injection delivery system for use with a fuel rail temperature compensation arrangement in accordance with the present invention.

FIG. 1 illustrates an exemplary adaptive fuel delivery control system 10 for use with the fuel rail temperature compensation arrangement in accordance with the present invention. System 10 consists of at least one fuel injector 12 which delivers fuel to an engine 28 during operation thereof. While four such injectors are shown, this is not to be construed as limiting. A fuel injection controller 32 such as in the form of a powertrain control module (PCM) controls operation of the fuel injector(s) 12 in accordance with any conventional fuel control algorithm strategy such as proportional integral (PI) with jump and ramp, proportional integral differential (PID), or equivalent thereof. Controller 32 includes a central processor unit (CPU), and an associated memory arrangement 38 including a KAM. Fuel 14 is transported from a fuel tank 18 to the injectors 12 via a returnless electronic pump 16, check valve(s) 22, fuel filter 24, fuel line 20, and a fuel manifold or fuel rail 26.

Controller 32 electrically controls the amount of fuel injected into the engine by the injectors via an appropriate pulsewidth signal as determined from the KAM memory. Controller 32 is responsive to a feedback signal from an oxygen sensor 34 coupled to an exhaust manifold (not shown) or other suitable location for controlling the A/F ratio of the engine during normal operation of the engine by generating an adjustment value to match the desired pulsewidth with the pulsewidth actually being generated by the fuel injectors. The oxygen sensor can be implemented in any suitable form, such as a heated exhaust gas oxygen (HEGO) type sensor, an exhaust gas oxygen (EGO) type sensor, or a linear type sensor such as a universal exhaust gas oxygen (UEGO) sensor. The controller is also responsive to other various powertrain actuators and sensors 36. The controller stores the determined adjustment values in the KAM.

In accordance with the present invention, rail temperature compensation is performed separately from the normal A/F ratio adaptive mode of operation of system 10. More specifically, the elimination of a return line in the electronic returnless fuel pump control system allows non-utilized fuel to remain in the fuel rail. The fuel and fuel rail may be heated because of physical proximity to the engine block and/or exhaust line. Enleanment may result due to changes in fuel density which could require a corresponding change in the fuel adaptive correction factor, and changes in the electrical and mechanical characteristics of the fuel injectors which could contribute to a drift in KAM values.

To correct for this problem of unintended enleanment, controller 32 is suitably programmed to continually carry out rail temperature based compensation as described more fully below. Because the monitoring process is continual, the compensation routine of the present invention is advantageously effective throughout the entire operation of the engine. A rail temperature sensor 30 is used in the preferred embodiment to provide an accurate measurement of fuel rail temperature, however, the use of an actual temperature sensor is not to be construed as limiting because rail temperature could be alternatively found via a lookup table of values inferred through appropriate modeling as a function of other sensed engine operating conditions.

Figure 2:
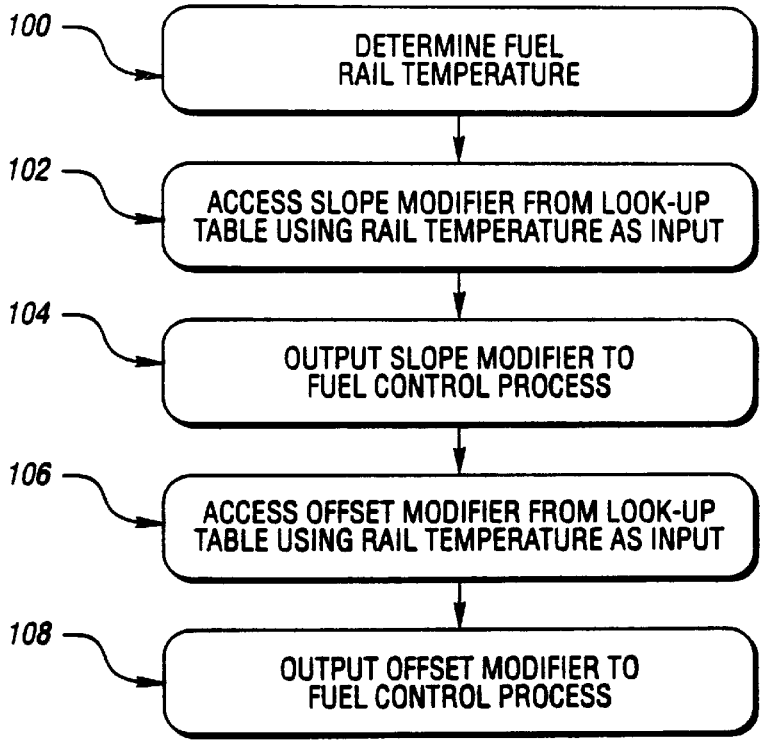
FIG. 2 is a flowchart illustrating the basic operation of the present invention.

The overall operation of rail temperature compensation routine will now be described in context with the flowchart shown in FIG. 2. In accordance with the present invention, after system initialization at engine startup and execution of other appropriate housekeeping procedures, such as updating of a system run timer, fuel rail temperature is initially determined at block 100 during predetermined sampling periods. As noted previously, in the preferred embodiment, actual fuel rail temperature is measured by temperature sensor 30. A compensation factor for compensating change in fuel density is generated based on the detected rail temperature. As shown at block 102, one way of achieving this is by using the determined fuel rail temperature as an input value for accessing a one dimensional lookup table (fox) of predetermined, hardware specific modifier values (FNRT_SLOPE). An alternative approach could include a specific compensation calculation subroutine executed by controller 32 in which the detected rail temperature value is used as an input to a computational formula. The accessed value is then applied at block 104 to slope and break point calculations by controller 32 as part of an injector slope calculation to produce a particular modification to counter fuel rail temperatures. This allows controller 32 to modify the A/F ratio actually produced by the fuel injectors separately from the general adaptive A/F ratio process.

In further accordance with the present invention, if a rail temperature input falls between respective lookup table entries, the controller accesses all adjacent values from the table and performs an averaging process to derive an appropriate modifier value.

Changes in fuel injector physical characteristics are likewise countered by generating a compensation factor at block 106 based on the determined fuel rail temperature. As with the slope modifier, rail temperature is preferably used as an input to a similar one dimensional lookup table of values (FNRT_OFFSET) correlated with desired changes in hardware specific physical characteristics. However, this too could be accomplished via a formula executed in a suitable subroutine. The generated offset value is then applied at block 108 by controller 32 to a standard adaptive offset calculation. As described above, an averaging process is performed to derive an appropriate modifier value when the rail temperature input falls between adjacent table entries.

Thus, generation of the necessary injector compensation enrichment factors in the preferred embodiment is summarized as follows:

(1) slope_mul=fox(FNRT_SLOPE, ful_railtemp); and (2) offset_mul=fox(FNRT_OFFSET, ful_railtemp).

Therefore, the present invention provides a method and system for compensation of fuel rail temperature in a returnless fuel delivery system which does not utilize or enable a vehicle's general A/F ratio adaptive control process to adjust fuel delivery (pulsewidth) to counter the unintended enleanment, thereby eliminating any unnecessary adaptive processing and limiting of the adaptive control range.

While the best mode for carrying out the invention has been described in detail, those familiar with the art to which this invention relates will recognize various alternative designs and embodiments for practicing the invention as defined by the following claims.

What is claimed is:

1. A method for compensating fuel rail temperature in a vehicle fuel delivery control arrangement to improve control of fuel delivered by at least one fuel injector to an internal combustion engine comprising:

detecting fuel rail temperature;

generating an injector slope compensation factor for a change in fuel density based on the detected rail temperature;

generating an injector offset compensation factor for a change in fuel injector physical characteristics based on the detected rail temperature; and modifying the amount of fuel delivered by the at least one fuel injector based on both the generated slope and offset compensation factors, wherein generating the slope compensation factor comprises using the detected fuel rail temperature as an input value for accessing a lookup table of predetermined slope modifier values.

2. The method of claim 1 wherein detecting fuel rail temperature comprises reading a temperature sensor coupled to the fuel rail.

3. The method of claim 1 wherein detecting fuel rail temperature comprises inferring temperature based on engine operating conditions.

4. The method of claim 1 wherein generating the offset compensation factor comprises using the detected fuel rail temperature as an input value for accessing a lookup table of predetermined offset modifier values.

5. The method of claim 4 further comprising detecting that a rail temperature input value falls between adjacent values stored in either lookup table, and averaging the adjacent values to generate the compensation factor.

6. The method of claim 1 wherein generating the injector slope and injector offset compensation factors is performed separately from any other vehicle fuel delivery control process.

7. A system for compensating fuel rail temperature in a vehicle fuel delivery arrangement separately from any other adaptive fuel process comprising:

at least one fuel injector for supplying fuel to an internal combustion engine;

a fuel rail temperature detector arrangement for detecting temperature of the fuel rail; and a microprocessor-based controller responsive to the fuel rail temperature detector arrangement and arranged to generate both a slope compensation factor to compensate for changes in fuel density and an offset compensation factor to compensate for changes in fuel injector physical characteristics based on the detected rail temperature, and modify a control signal to adjust the amount of fuel delivered by the at least one fuel injector based on the generated compensation factors, wherein said controller is arranged to generate the slope compensation factor by using the detected fuel rail temperature as an input value for accessing a lookup table of predetermined slope modifier values.

8. The system of claim 7 wherein said fuel rail temperature detector arrangement comprises a temperature sensor connected to the fuel rail.

9. The system of claim 7 wherein said fuel rail temperature detector arrangement comprises a means for inferring rail temperature based on engine operating conditions.

10. The system of claim 7 wherein the controller is arranged to generate the injector slope and injector offset compensation factors separately from any other vehicle fuel delivery control process.

11. The system of claim 10 wherein said controller is further arranged to generate the offset compensation factor by using the detected fuel rail temperature as an input value for accessing a lookup table of predetermined offset modifier values.

12. The system of claim 11 wherein said controller is further arranged to detect that a rail temperature input value falls between adjacent values stored in either lookup table, and average the adjacent values to generate the compensate factor.

* * * * *